US008226534B2

(12) United States Patent
Chaturvedi

(10) Patent No.: US 8,226,534 B2
(45) Date of Patent: Jul. 24, 2012

(54) APPARATUS AND A METHOD FOR MAKING PACKAGES AND A PACKAGE THEREOF

(76) Inventor: Ashok Chaturvedi, New Delhi (IN)

( * ) Notice: Subject to any disclaimer, the term of this patent is extended or adjusted under 35 U.S.C. 154(b) by 0 days.

(21) Appl. No.: 12/621,597

(22) Filed: Nov. 19, 2009

(65) Prior Publication Data

US 2010/0069212 A1 Mar. 18, 2010

Related U.S. Application Data

(63) Continuation of application No. PCT/IN2008/000436, filed on Jul. 8, 2008.

(30) Foreign Application Priority Data

Jul. 9, 2007 (IN) ..... 1448/DEL/2007

(51) Int. Cl.
*B31B 37/02* (2006.01)

(52) U.S. Cl. ..... 493/198; 493/218; 493/189; 493/194; 493/212; 493/223

(58) Field of Classification Search ..... 493/197, 493/218, 189, 198, 243, 249, 186, 193, 194, 493/210, 212, 223, 224
See application file for complete search history.

(56) References Cited

U.S. PATENT DOCUMENTS

| | | | | | |
|---|---|---|---|---|---|
| 2,125,306 | A | * | 8/1938 | Novick | 493/235 |
| 4,840,611 | A | * | 6/1989 | Van Erden et al. | 493/213 |
| 4,913,693 | A | * | 4/1990 | Ball et al. | 493/194 |
| 4,929,224 | A | | 5/1990 | Hanson et al. | |
| 5,056,931 | A | * | 10/1991 | Williams | 383/8 |
| 5,102,384 | A | | 4/1992 | Ross et al. | |
| 5,147,272 | A | * | 9/1992 | Richison et al. | 493/195 |
| 5,181,365 | A | * | 1/1993 | Garvey et al. | 53/455 |
| 5,311,726 | A | * | 5/1994 | Rauscher et al. | 53/511 |
| 5,376,202 | A | * | 12/1994 | Maresh | 156/203 |
| 5,393,143 | A | * | 2/1995 | Muhs | 383/21 |
| 5,524,420 | A | * | 6/1996 | Ikuta | 53/450 |
| 5,653,085 | A | * | 8/1997 | Suga | 53/75 |
| 5,826,403 | A | * | 10/1998 | Haley | 53/450 |
| 6,056,681 | A | | 5/2000 | Ross | |
| 6,068,585 | A | * | 5/2000 | Ouchi | 493/213 |
| 6,425,847 | B1 | * | 7/2002 | Broenstrup | 493/231 |

(Continued)

FOREIGN PATENT DOCUMENTS

EP 1 106 339 A2 6/2001

(Continued)

OTHER PUBLICATIONS

International Search Report and Written Opinion for PCT/IN2008/000436, mailed Dec. 22, 2008, 14 pages.

*Primary Examiner* — Christopher Harmon

(57) ABSTRACT

This invention provides an apparatus and a method for making package which has less rejection rate during manufacturing. The method in the present invention also produces packages with good dimensional accuracy. The apparatus in the present invention is provided for making three side gusset package with improved method of feeding side gusset tube and feeding bottom gusset along with web registration of bottom and side gusset to have printing perfectly located and aligned on package surfaces such that the images or graphics can be printed partially on front side & back side, continuing over side and bottom gusset surfaces.

14 Claims, 11 Drawing Sheets

U.S. PATENT DOCUMENTS 6,561,963 B2 5/2003 Totani
6,692,148 B2 2/2004 Totani
6,796,932 B2 * 9/2004 Kuge et al. ..... 493/218
6,807,794 B2 * 10/2004 Ausnit et al. ..... 53/412
6,986,237 B2 * 1/2006 Ausnit et al. ..... 53/412
7,490,451 B2 * 2/2009 Matthews ..... 53/412

FOREIGN PATENT DOCUMENTS

EP 1 250 999 A1 10/2002
WO WO 2005/113357 A1 12/2005

* cited by examiner

D2
B2
B1

APPARATUS AND A METHOD FOR MAKING PACKAGES AND A PACKAGE THEREOF

CROSS-REFERENCE TO RELATED APPLICATIONS

This application is a continuation of PCT Application No. PCT/IN2008/000436, filed Jul. 8, 2008, which claims priority to and the benefit of Indian Application No. 1448/DEL/2007, filed Jul. 9, 2007, each of which is incorporated herein by reference in its entirety.

FIELD OF INVENTION

This invention relates to an apparatus for making packages, a method for making packages and a package manufactured by said apparatus and method.

BACKGROUND OF THE INVENTION

Packages with three side gusset are available on the market today for packing liquids and solids and different manufacturing methods are used for the same. These kinds of bags with three side gussets are known in the numerous embodiments, which depend on the use, to which they are to be put. One type of plastic bag forming machine and method of operation is disclosed in U.S. Pat. No. 4,929,224 to Hanson et al., which uses closed sleeve plastic material with inwardly gusseted sides as a raw starting material. Another method of making flat-bottomed plastic bags is disclosed in U.S. Pat. No. 5,102,384.

U.S. Pat. No. 6,056,681 provides a method and apparatus for forming flat-bottomed plastic bags which gives more consistent and precise results than are obtainable using pre-gusseted tubing.

The plastic bag is advantageous in that the first and second side gusset portions can be unfolded between the first and second side edges respectively to obtain a large capacity. The bottom gusset portion and the first and second auxiliary gusset portions can also be unfolded between the bottom edges to constitute a rectangular bottom. The plastic bag can therefore stably stand on a table. However, it has been heretofore difficult to successively make the plastic bags. Further, there are several method of manufacturing the packages with three side gussets are also disclosed in various patent applications and patents.

U.S. Pat. No. 6,561,963 and EP 1106339 disclose a new and improved apparatus for successively making plastic bags where every bag is completed with first and second side gusset portions and then a bottom gusset portion. U.S. patent application Ser. No. 10/052,267 which is continuation application with respect to said U.S. Pat. No. 6,561,963 and matured as U.S. Pat. No. 6,692,148 provides plastic bag making apparatus.

U.S. Pat. No. 6,425,847 provides a method for producing a packing material from plastic film or a similar weldable material in the form of a bag or sack with side folds of the initially given type.

In our co-pending application number 582/MUM/2004, we have described a reclosable flexible package with a slider zipper assembly and three-side gusset having a handle and a method of manufacturing the same.

However the methods used in the above-mentioned documents are very complicated. Further, the methods used in the above-mentioned patent applications/patents increase the rejection rate in the manufacturing of package. Additionally, packages produced by the methods and apparatus disclosed in the documents may not have good dimensional accuracy.

OBJECTS AND SUMMARY OF THE INVENTION

To overcome the aforementioned drawbacks, this invention provides for an apparatus for making packages, a method for making packages and a package thereof.

It is an object of the invention to provide an apparatus and a method for making packages which are simple.

It is another object of the invention to provide an apparatus and a method for making package which has less rejection rate.

It is yet another object of the present invention to provide an apparatus and a method for making package with good dimensional accuracy.

BRIEF DESCRIPTION OF THE DRAWINGS

The accompanying drawings illustrate the preferred embodiments of the invention and together with the following detailed description, serve to explain the principles of the invention.

The apparatus for making three side gusset package with improved method of feeding side gusset tube and feeding bottom gusset along with web registration of bottom and side gusset to have printing perfectly located and aligned on package. With help of this method, we can have image or graphics printed partially on front & back portion along with side and bottom gusset.

DETAILED DESCRIPTION

It will be understood by those skilled in the art that the foregoing general description and the following detailed description are exemplary and explanatory of the invention and are not intended to be restrictive thereof.

Figure 1:
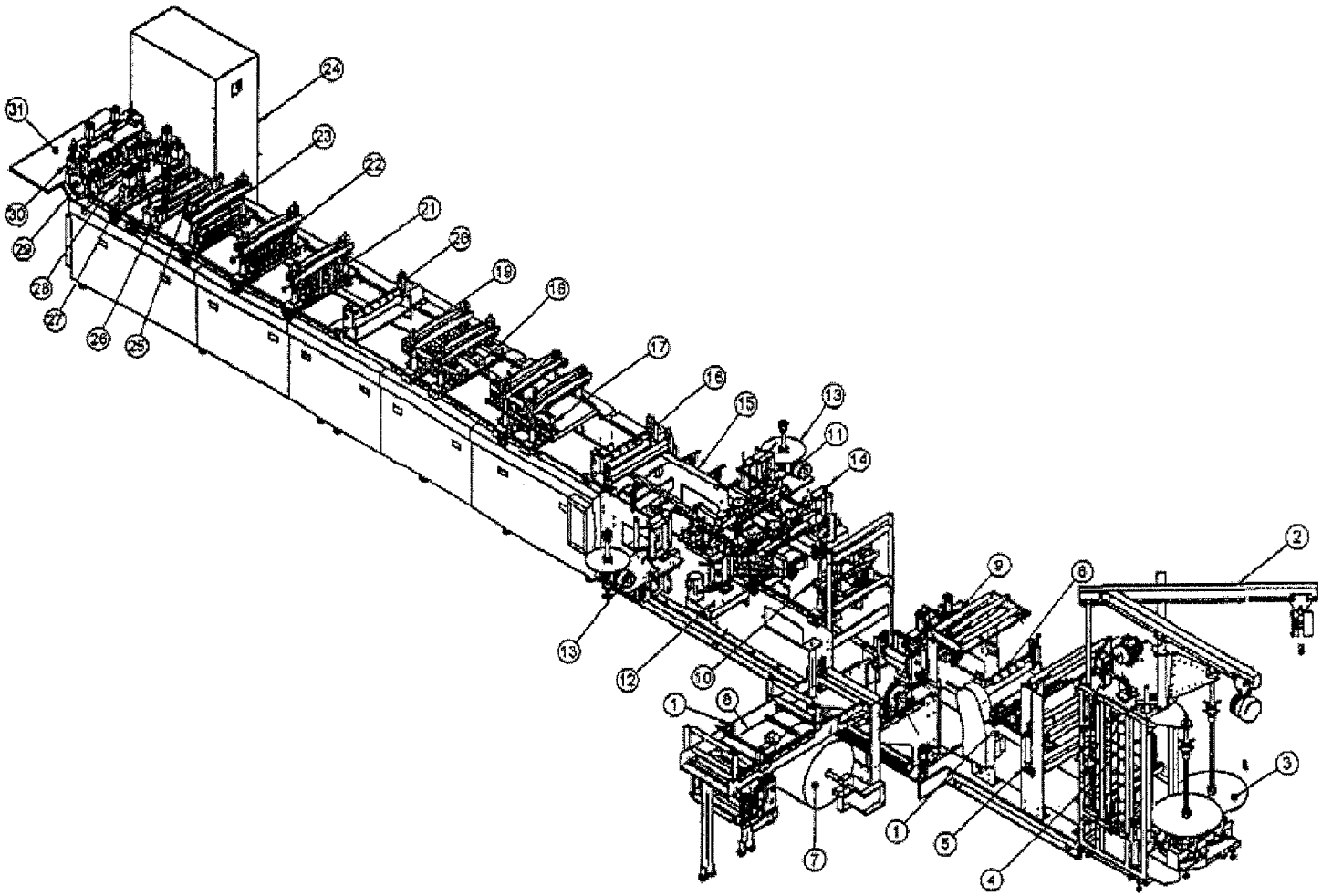
FIG. 1 shows an apparatus for making a package according to the present invention.

FIG. 1 shows an apparatus for making a package according to the present invention.

A horizontal package making machine with improved method of inserting side and bottom gusset where a roll of film/laminate is loaded vertically on main unwind (3) of machine with reel loading (2). The said film/laminate passes through unwind pulling (4) and pulled forward with the help of horizontal dancer (5) with AC variable drive. The film/laminate is cut into two equal parts. One layer moves on top & one at bottom. For proper registration of machine mark, servo motor is provided at (6) which pulls the bottom film with perfect registration.

Figure 2:
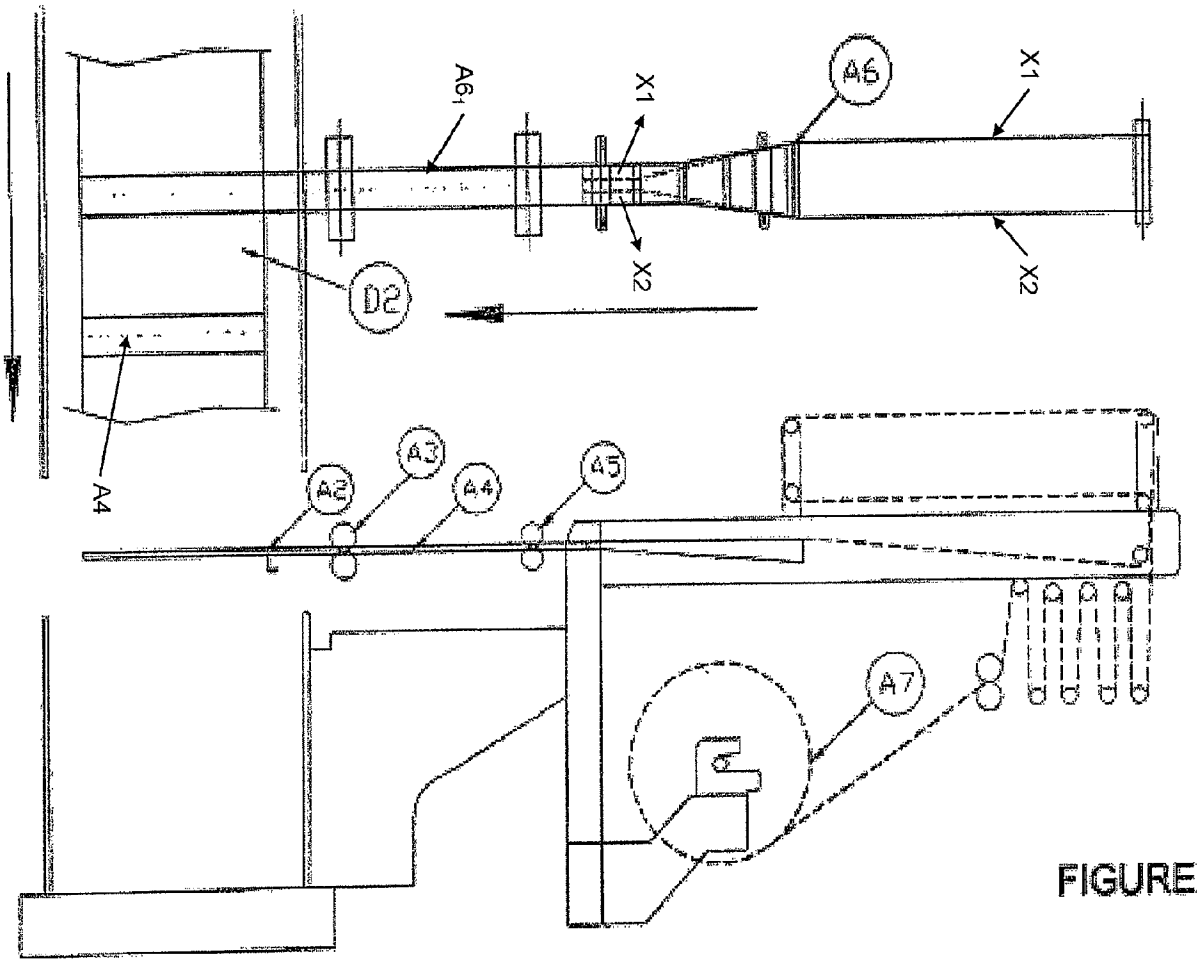
FIG. 2 depicts material flow and forming of side gussets.

A tube web ($A6_1$) of film/laminate is formed at side gusset forming unit (8). Said tube web ($A6_1$) is fed on bottom sheet in such a manner that a portion of the tube web ($A6_1$) joint remains at the bottom web. The portion of tube web ($A6_1$) is then sealed with bottom web with the help of side gusset tagging attachment (9), and subsequently cut by a cutting unit (A2) to obtain a side gusset tube (A4), as shown in FIG. 2. The said tube is sealed with top web with the help of sealer (10). Top web joins the bottom web after sealing at station (10). The top and bottom webs are pulled apart using rollers to form rhombus shape at station 14.

The film/laminate is folded flat over the side of the top and bottom gusset with the help of bottom folding, creasing & tagging unit (14) for making the bottom gusset.

The bottom gusset feeding starts from unwinding station at (13). The film/laminate moves continuously from side and joins with top & bottom webs and side gussets.

The said top & bottom webs with side and bottom gussets passes through bottom center folding former (15) to flatten the bottom gusset horizontally. The top web is pulled to sealing and cooling station with the help of draw roller (16). The said top & bottom webs along with bottom gusset then move to station (17) for bottom sealing and subsequent cooling unit (18). The said three side gusset film/laminate then moves towards slider & Zipper loading station 19) with or without diaphragm (in case of one up package. The film/laminate moves forward through draw roller (20) for bottom sealing/fusing and cooling station (21). The said three side gusset film/laminate then moves to station (22) for cross sealing and cross cooling (23). The said three side gusset film/laminate then moves to side trimming unit (25) for trimming of excess sealed area on top & bottom webs. The said 3-side gusset film/laminate proceeds towards station (27) for bottom round corner punching, if desired. Center slitting (28) is required for 2-up package line to slit and to separate formed & sealed webs into two halves to form two packages. A servo puller is attached at station (29) for pulling the film/laminate. Finally a combination of two special type of fly blades operation is attached at station (30) which moves to & fro for strip cutting in the sealed area and finally makes one three side gusseted package in case of one up machine and two numbers of three side gusseted packages in case of two up machine.

As shown in the figure, unwinding of film/laminate starts from station (3), (7) and (13). The final stage of receiving the finished packages at the extreme end of the machine on working table (31).

FIG. 2 depicts material flow and foaming of film/laminate tube for side gussets. It explains the flow of film/laminate (A6) for the formation of side gussets tube (A4), after unwinding. The bottom film/laminate web (D2) flows horizontally to the machine and the film/laminate (A6) for the side gussets tube (A4) flows in a perpendicular direction to the bottom film/laminate web (D2), as shown in FIG. 2. For preparing the side gussets tube (A4), first the film/laminate (A6) is formed in a tube shape web ($A6_1$) with open ends (X1, X2) folded towards the bottom film/laminate web (D2), as shown by the dotted line in FIG. 2, and passes to a set of rollers (not identified) for creasing the end of the tube web ($A6_1$). A servo puller (A3) is attached for pulling the tube web ($A6_1$) and feeding it over the bottom film/laminate web (D2). The tube web ($A6_1$) for the side gusset tube (A4) is cut as shown by a cutting unit (A2) when it is tagged/sealed over the bottom film/laminate web (D2).

Figure 3:
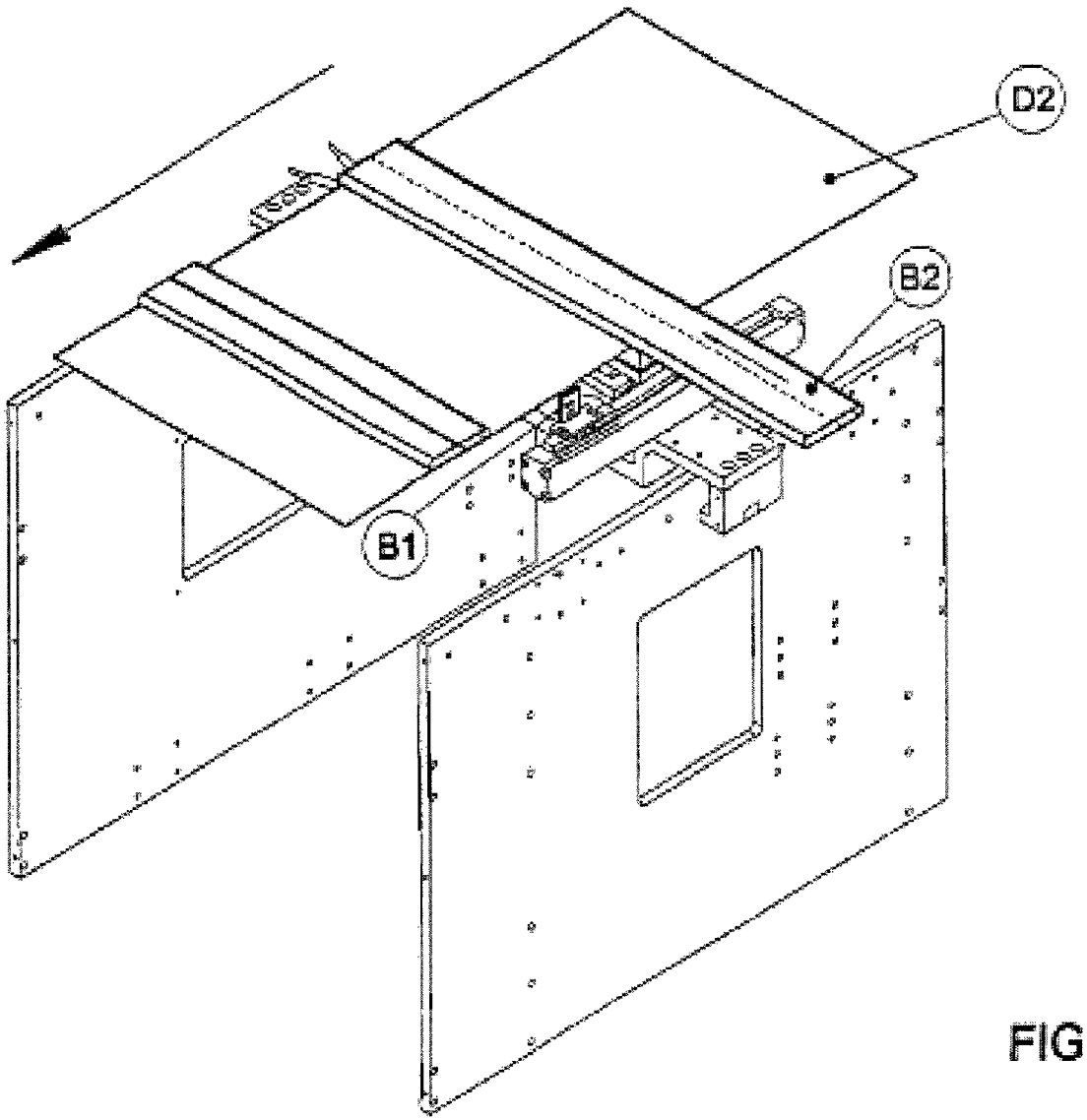
FIG. 3 shows cutting of the side gusset over bottom sheet.

FIG. 3 shows cutting of the tube for side gussets over bottom web. It explains cutting position (B1) on the tube for side gussets (B2) when it comes over the bottom film/laminate web (D2).

Figure 4:
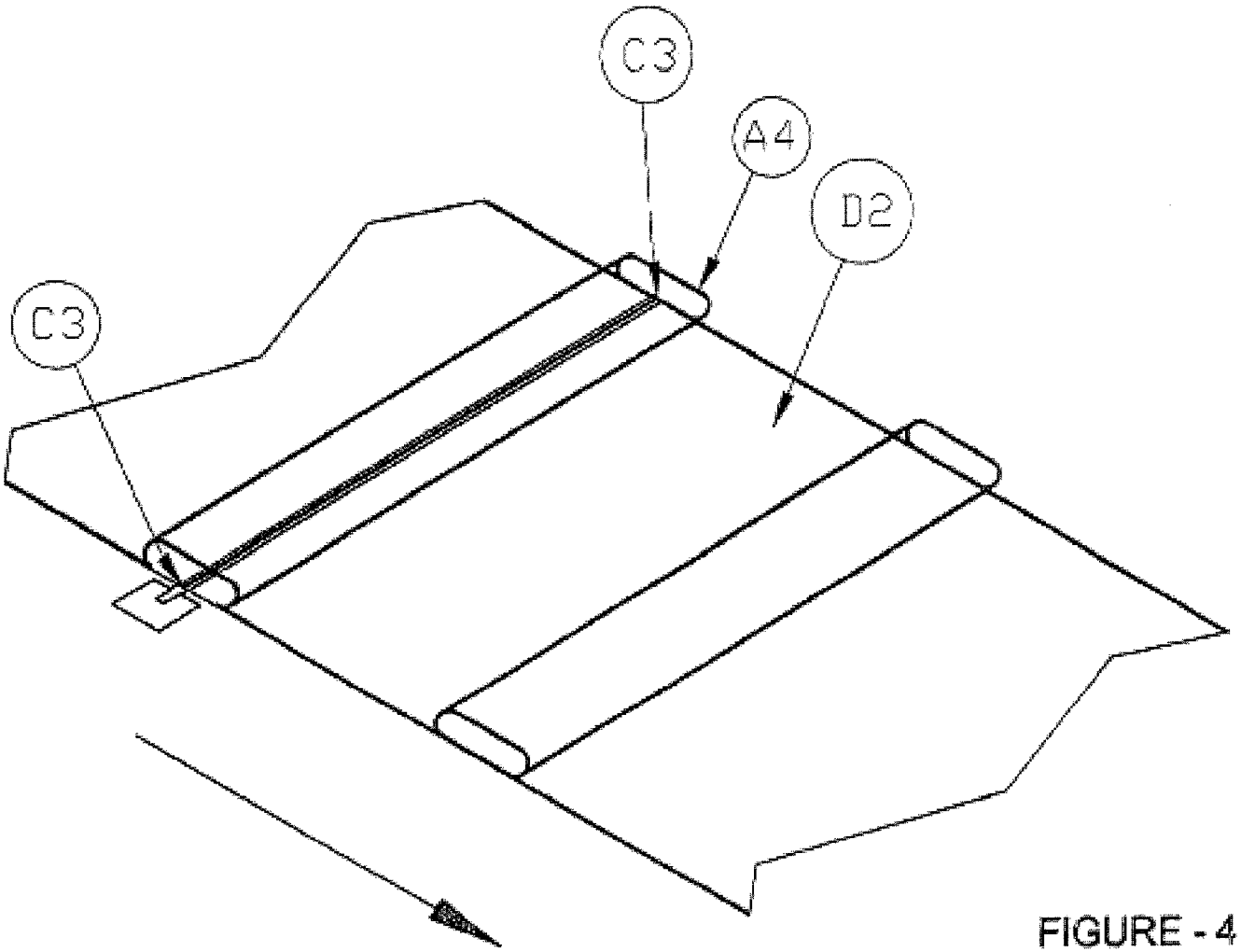
FIG. 4 shows sealing of side gusset.

FIG. 4 shows sealing of tube for side gussets. It shows tagging/sealing of tube for side gusset at (C3) over bottom film/laminate web (D2). The process fixes the position of tube for side gussets (A4) over the bottom film/laminate web, as shown in FIG. 1 at (9).

Figure 5:
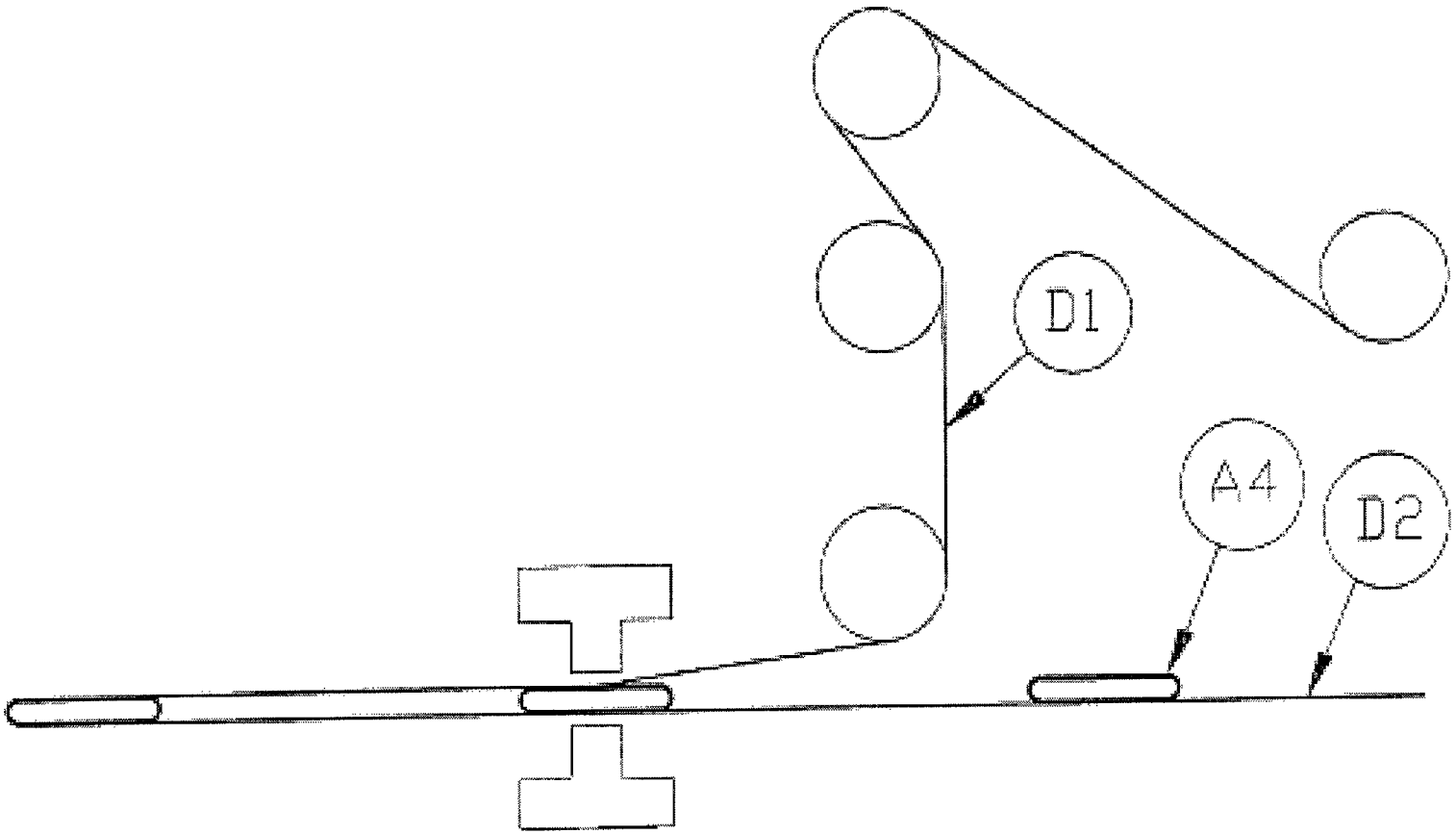
FIG. 5 shows the sealing of top and bottom sheet with side gusset.

FIG. 5 shows the sealing of top and bottom film/laminate web with tube for side gussets (A4). It shows the flow & sealing of top film/laminate web (D1) & bottom film/laminate web (D2) with tube for side gussets (A4). This stage is as shown in FIG. 1 at station (10).

Figure 6:
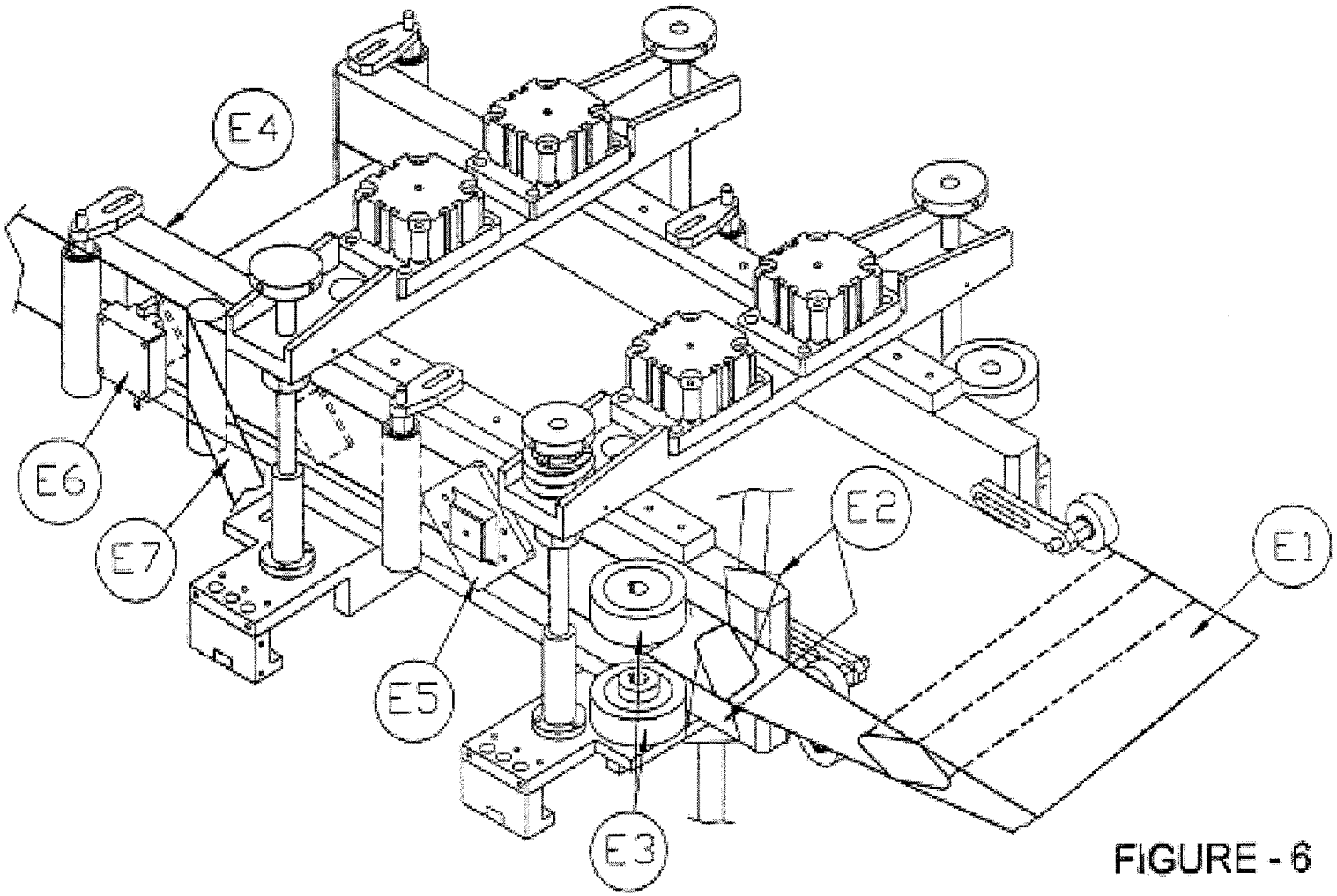
FIG. 6 represents sealing of the bottom gusset with side gusset.

FIG. 6 represents sealing of the bottom gusset along with tube for side gussets. This shows the flow of top and bottom film/laminate web sealed with tube for side gussets (E1) and formation of the tube for side gussets to a rhombus shape through set of rollers (E2) & (E3). The said film/laminate then moves through creasing plate (E5) for flattening the surface of rhombus made on tube for side gussets. After creasing of tube for side gussets, the bottom gusset film/laminate (E7) is inserted over flattened rhombus on the tube for side gussets. Now bottom gusset and tube for side gussets pass through stage (E6) for sealing.

Figure 7:
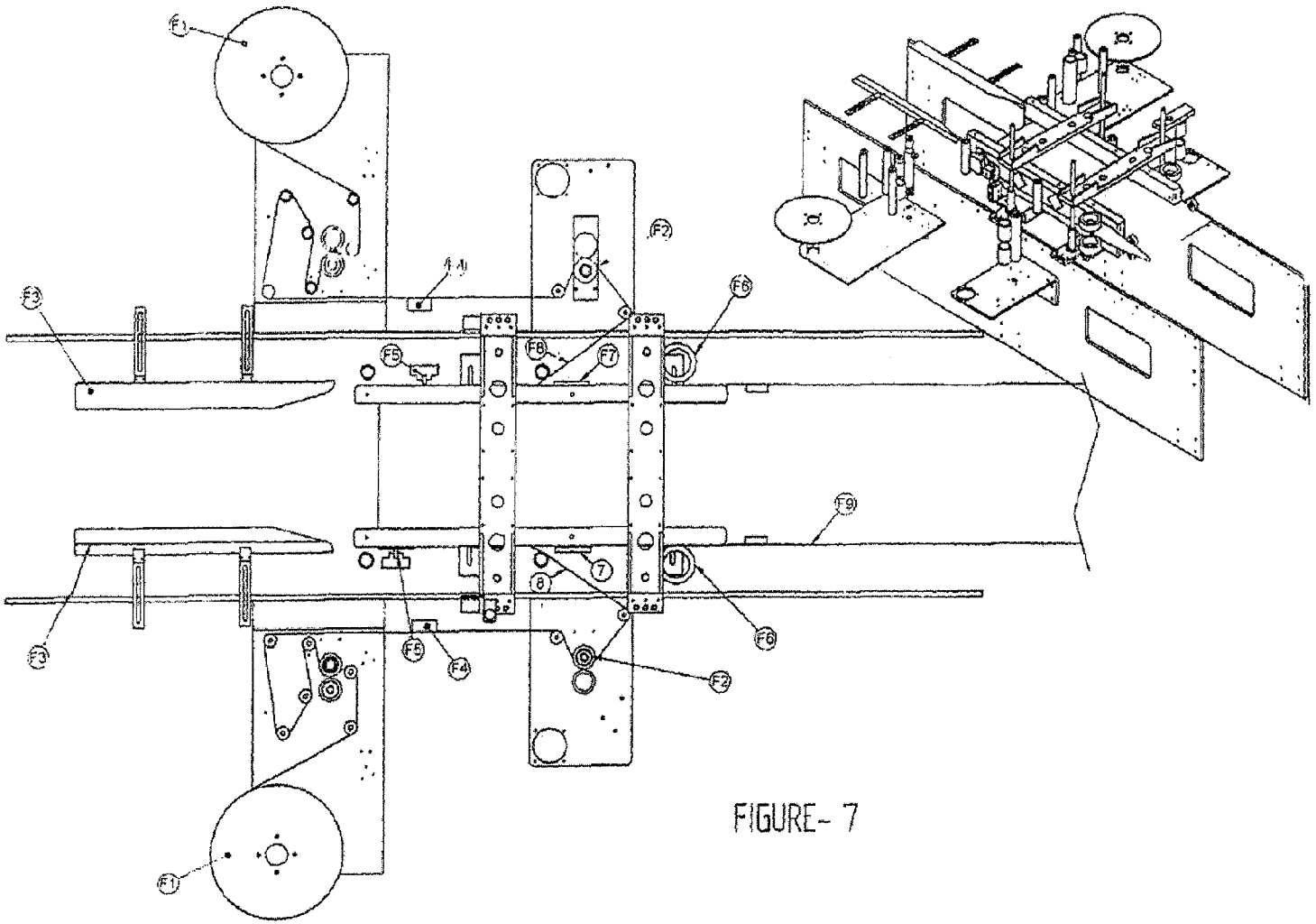
FIG. 7 represents sealing of the registered bottom gusset along with top and bottom sheet.

FIG. 7 represents sealing of the registered bottom gusset along with top and bottom webs.

It explains the film/laminate for bottom gusset unwinding layout (F1). The film/laminate is pulled by a precise pulling means (F2). Said precise pulling means can be servo puller. Bottom gusset servo puller (F2) is used for pulling the. The film/laminate for bottom gusset (F8) moves forward for bottom gusset tagging at (F5) before entering into bottom gusset center folder (F3). Forming roller (F6) is to press the film/laminate (F9). Folding is done through creasing plate (F7). The bottom gusset photocell (F4) is used for proper alignment of the bottom gusset.

Figure 8:
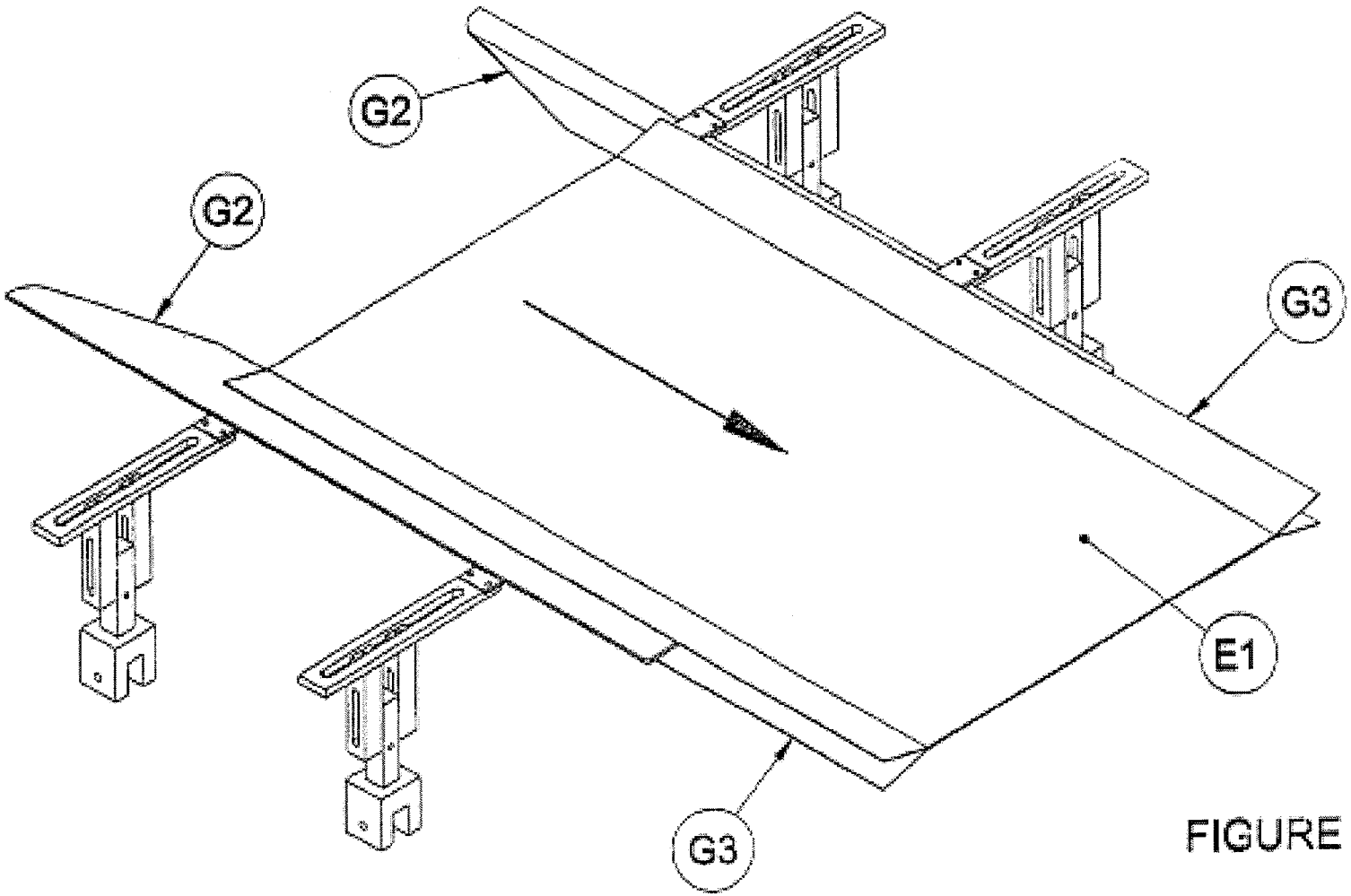
FIG. 8 represents the folding of the bottom gusset.

FIG. 8 represents the folding of the bottom gusset. This drawing explains the bottom fold (G3) in bottom gusset formed when it moves along with top & bottom webs sealed with tubes for side gussets (E1) through bottom gusset center folder (G2).

Figure 9:
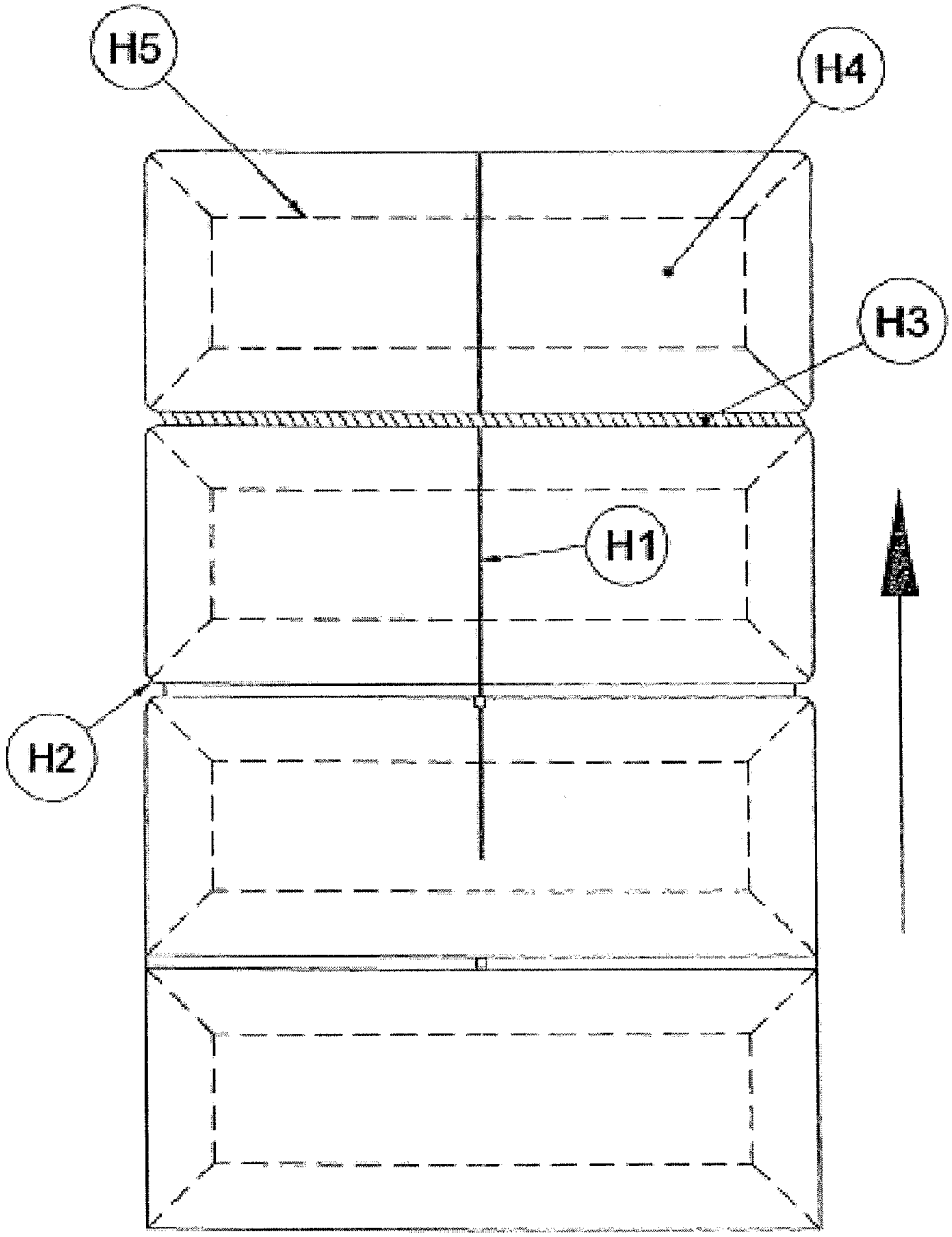
FIG. 9 represents the flow indication of the packages and cutting the package.

FIG. 9 represents the flow indication of the packages and cutting the packages. It explains the position of bottom round corner (H2) shaped through a punching device, position of center slitting (H1) for two up package and finally cutting the package by a set of two blades for strip (H3) cutting to separate the packages from continuous line.

Figure 10:
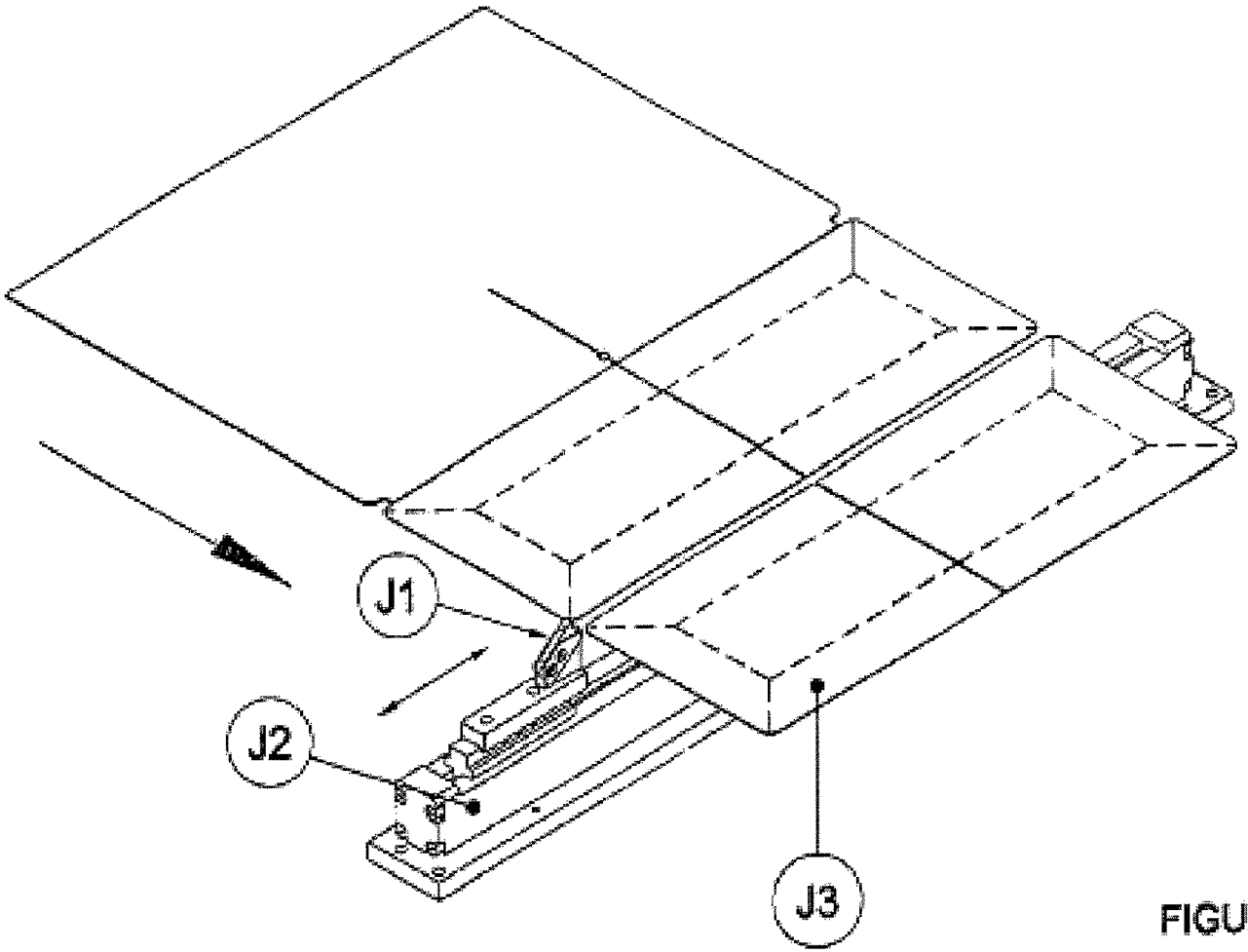
FIG. 10 shows cutting of the final package.

FIG. 10 shows cutting of the final packages. It explains the cutting attachment for separation the final package (J3) through a double blade cutting attachment (J1) actuated through a pneumatic or hydraulic or mechanical or any other suitable means (J2). Special type of fly Knife (blade) mechanism is used to cut the packages.

Figure 11:
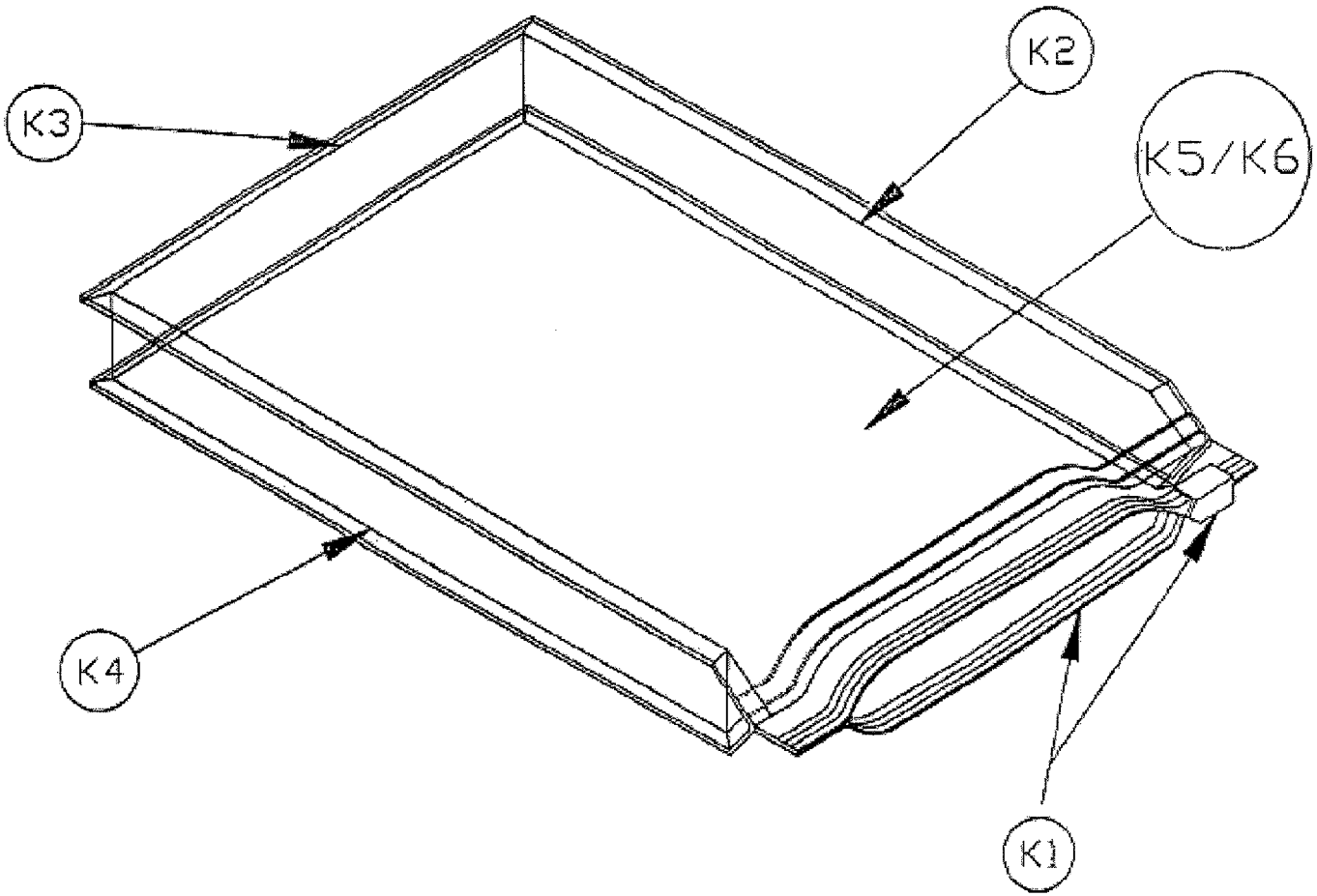
FIG. 11 depicts a three side gusset package manufactured by the above-mentioned apparatus and method.

FIG. 11 depicts a three side gusset package manufactured by the above-mentioned apparatus and method. It shows the finished final package with three gussets (K2), (K3) (K4) and front side (K5), back side (K6). Other side of the package is attached with zipper slider/press to lock zipper (K1), with or without diaphragm for re closing and opening the mouth for filling or taking out the product.

Through out the patent specification, a convention employed is that in the appended drawings, like numerals denote like components.

It will be readily appreciated by those skilled in the art that the present invention is not limited to the specific embodiments herein shown. Thus variations may be made within the scope without sacrificing the principal advantages of the invention. For example, said three side gusset film/laminate then moves towards station (19) for making packages with zipper slider/press to lock zipper with or without diaphragm to make the package re-closable in case of one up package.

In another aspect of the invention a diaphragm of film or laminate with or without metalized film, is placed below the zipper assembly to close the mouth of the package and act as barrier, making it tamper proof. A perforations or laser scoring line on said diaphragm can be provided for making it easier and more convenient for the user to tear open and access the contents of the package.

In another embodiment of the invention a handle is provides for easy carrying and handling of the filled package. A pre-cut handles are inserted on top and bottom webs opposite to the bottom gusset.

In yet another embodiment of the invention a slider zipper assembly/press to lock zipper, a diaphragm, a scoring on said diaphragm and a handle is attached to the package.

I claim:

1. An apparatus for making packages, said apparatus comprising:

a reel loader that, during operation, loads a first film/laminate roll on an unwind;

means for splitting the loaded first film/laminate into a top web and a bottom web;

a first unit that, during operation, forms a tube web for a side gusset from a second film/laminate, the second film/laminate having a first portion and a second portion, the first unit, during operation, folds the longitudinal edges of the first portion of the second film/laminate towards the bottom web to form the tube web;

means for pulling and feeding the tube web over the bottom web;

a first sealing unit that, during operation, seals the tube web with the bottom web after the tube web is fed over the bottom web, the first sealing unit, during operation, seals the folded longitudinal edges of the first portion of the second film/laminate with the bottom web to seal the tube web with the bottom web;

a cutting unit that, during operation, forms a side gusset tube by cutting the second film/laminate to sever the tube web formed by the first portion of the second film/laminate from the second portion of the second film/laminate, the cutting unit being co-located with the first sealing unit such that the tube web is sealed with the bottom web when the cutting unit cuts the second film/laminate;

a second sealing unit that, during operation, seals the side gusset tube formed by the cutting unit with the top web;

a second unit that, during operation, forms and tags a bottom gusset, a third film/laminate is provided from the side of the apparatus such that the top web, the bottom web and the side gusset tube remain together;

a third sealing unit that, during operation, seals the bottom gusset with the top web, the bottom web and one end of the side gusset tube;

a third unit that, during operation, fixes a top closing means at a top portion of the package; and a fourth unit that, during operation, strip cuts and forms one or more packages from the top web, the bottom web, the side gusset tube, the bottom gusset and the top closing means.

2. An apparatus for making packages as claimed in claim 1, wherein said apparatus further comprises a bottom gusset folding unit that, during operation, flattens the bottom gusset horizontally.

3. An apparatus for making packages as claimed in claim 1, wherein said apparatus further comprises a cross sealing unit and a cross cooling unit.

4. An apparatus for making packages as claimed in claim 1, wherein said apparatus further comprises a trimming unit that, during operation, trims excess sealed area around the bottom gusset.

5. An apparatus for making packages as claimed in claim 1, wherein said apparatus further comprises a punching unit that, during operation, punches round corners on the bottom web of the package.

6. An apparatus for making packages as claimed in claim 1, wherein said apparatus further comprises a slitting unit that, during operation, slits and to separates the top web, the bottom web, the side gusset tube, and the bottom gusset into two halves to form two packages.

7. An apparatus for making packages as claimed in claim 1, wherein the top closing means of the package is a slider zipper or press type zipper or press to lock zipper assembly.

8. An apparatus for making packages as claimed in claim 1, wherein the side gusset tube extends across the entire width of the bottom web.

9. An apparatus for making packages as claimed in claim 1, wherein the cutting unit, during operation, cuts the second film/laminate in a direction normal to the longitudinal edges of the second film/laminate.

10. A method for making packages, said method comprising the steps of:

loading a first film/laminate roll on a main unwind;

splitting the loaded first film/laminate into a top web and a bottom web;

forming a tube web from a second film/laminate by folding the longitudinal edges of the second film/laminate towards the bottom web;

pulling the tube web in a first direction to feed the tube web over the bottom web, the bottom web being positioned for movement in a second direction normal to the first direction when the tube web is pulled;

sealing the folded longitudinal edges of a first portion of the second film/laminate to the bottom web to seal a portion of the tube web with the bottom web;

after the sealing, cutting the portion of the tube web sealed with the bottom web in the second direction to form a side gusset tube;

sealing the side gusset tube with the top web;

forming a bottom gusset from a third film/laminate, the top web, the bottom web and the side gusset tube remaining sealed together during the forming of the bottom gusset; and fixing a top closing means at a top portion of the package after the bottom gusset is sealed with the top web, the bottom web, and the side gusset tube such that the package is formed.

11. A method for making packages as claimed in claim 10, wherein the step of forming the tube web comprises converting the tube web into a predetermined shape by a set of rollers and then flattening the folded ends tube web by a creasing plate.

12. A method for making packages as claimed in claim 10, wherein the bottom gusset is flattened horizontally by a bottom gusset folding unit.

13. A method for making packages as claimed in claim 10, wherein the excess sealed area around the bottom gusset is trimmed by a trimming unit.

14. A method for making packages as claimed in claim 10, further comprising punching round corners on the bottom web by a punching unit.

* * * * *